US005199513A

United States Patent [19]

Stewart et al.

[11] Patent Number: 5,199,513

[45] Date of Patent: Apr. 6, 1993

[54] SIDE-TRACKING MILLS

[75] Inventors: David Stewart, Stonehaven; Paul Hilliard, Aberdeen, both of United Kingdom; Thomas Doig, Nijverhedesdraat, Netherlands

[73] Assignee: Tri-State Oil Tool (UK), Aberdeen, United Kingdom

[21] Appl. No.: 654,086

[22] Filed: Feb. 11, 1991

[30] Foreign Application Priority Data

Feb. 10, 1990 [GB] United Kingdom ..... 9003047

[51] Int. Cl.[5] ..... E21B 10/26

[52] U.S. Cl. ..... 175/73; 175/385; 407/34; 408/203.5; 166/55.7

[58] Field of Search ..... 175/73, 385, 386, 406; 166/55.7; 407/34, 53, 54; 408/203.5, 223, 224, 227, 231

[56] References Cited

U.S. PATENT DOCUMENTS 2,014,805 9/1935 Hinderliter .
2,103,622 12/1937 Kinzbach .
2,882,015 4/1959 Beck .
3,051,255 8/1962 Deely ..... 175/406 X
3,301,339 1/1967 Pennebaker .
3,908,759 9/1975 Cagle et al. .
4,266,621 5/1981 Brock ..... 175/385 X
4,610,320 9/1986 Beakley .
4,618,010 10/1986 Falgout, Sr. et al. ..... 175/385 X
4,646,857 3/1987 Thompson .
5,010,967 4/1991 Desai ..... 166/55.7 X
5,012,863 5/1991 Springer ..... 166/55.7

FOREIGN PATENT DOCUMENTS 0231989 1/1987 European Pat. Off. .
0266864 8/1987 European Pat. Off. .

*Primary Examiner*—William P. Neuder
*Attorney, Agent, or Firm*—Ratner & Prestia

[57] ABSTRACT

The invention, which can be applied to both starting mills and window mills for use in sidetracking a cased borehole, makes use of carbide discs as cutting elements and the geometrical disposition of blades on which the discs are mounted to enhance cutting efficiency. The blades are angularly offset with respect to the tool centerline in a variety of configurations.

15 Claims, 4 Drawing Sheets

SIDE-TRACKING MILLS

This invention relates to mills for use in sidetracking boreholes such as oil wells.

BACKGROUND OF THE INVENTION

Sidetracking of wells is a well-known procedure in which a new borehole is initiated at a small angle to an existing cased hole. The existing hole is closed by a packer below the intended sidetracking site, and a whipstock is secured on the packer to present an angled flat face towards the top of the well. A starting mill is then run into the well; the starting mill has a tapered nose to engage the angled face of the whipstock and side cutters which, when the string is rotated, cut an angled notch in the casing. The starting mill is then removed and replaced with a window mill. This is engaged in the notch and rotated to cut an elongate window through the casing and to form an initial length of the sidetrack bore.

The time taken to perform a sidetracking operation thus depends on the rate of penetration and reliability of the starting mill and the window mill. Mills used hitherto achieve only a modest performance. Starting mills require a high operating torque and tend to rotate unevenly or jam. Window mills have very poor penetration rate during part of the window-forming operation, to such an extent that they are frequently pulled because the operator suspects major damage to the tool but no such damage is found on recovery of the tool.

SUMMARY OF THE INVENTION

Accordingly, an object of the present invention is to provide improved mills for use in well sidetracking, in which the above problems are overcome or mitigated.

The invention provides a milling tool for use in sidetracking a borehole, comprising a generally tubular body, means at one end of the body for connecting the tool to the end of a drill string, and a plurality of cutting blades extending from and spaced around the body, each blade having a forward face in the direction of rotation provided with cutting elements in the form of carbide discs secured thereto, and each blade being angularly offset from the longitudinal axis of tubular body.

In one form, the milling tool is a starting mill, in which the end of the body opposite said one end is formed as a tapered nose, said blades are positioned on the body behind said tapered nose with the front surfaces of the carbide discs lying in planes which are radial of the body, and the blades have radially outer edges inclined at an angle to the longitudinal axis of the body such that the outside diameter of the tool across the blades is less towards said one end than towards said tapered nose.

In another form, the milling tool is a window mill, each blade having a first portion extending along the side of the body and a second portion extending across the end face of the body opposite said one end such that the front faces of the carbide discs on each blade lie in a plane displaced from a radial plane of the body.

BRIEF DESCRIPTION OF THE DRAWINGS

Embodiments of the present invention will now be described, by way of example, with reference to the accompanying drawings, in which.

DESCRIPTION OF PREFERRED EMBODIMENTS

Figure 1:
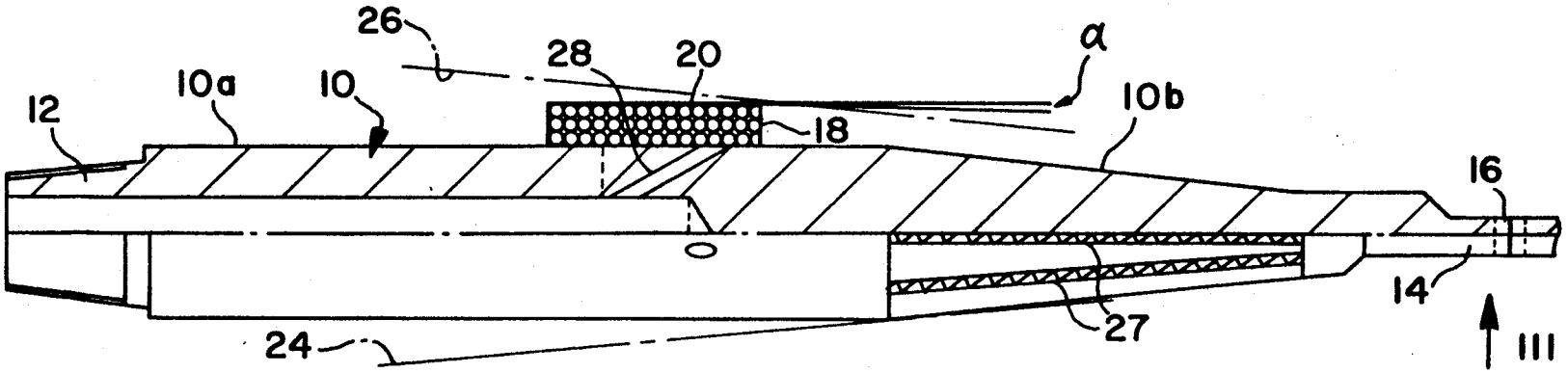
FIG. 1 is a side view, partially in section, of a starting mill forming one embodiment of the invention.
Figure 3:
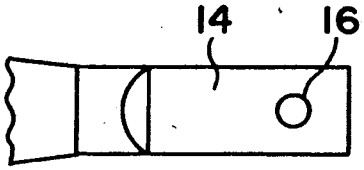
FIG. 3 is a partial view on the arrow III of FIG. 1.
Figure 2:
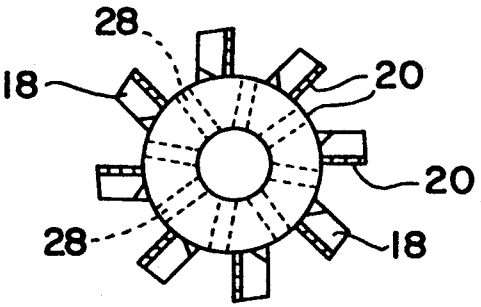
FIG. 2 is an end view of the mill of FIG. 1.

Referring to FIGS. 1 to 3, a starting mill comprises a generally cylindrical steel body 10 one end of which is formed with a standard threaded pin connector 12 for attaching the mill to the end of a drill string. The trailing portion 10*a* of the body 10 is parallel sided, while the leading portion 10*b* is tapered to form a nose, the extreme leading end being formed as a flat 14 with a through bore 16 for receiving a shear pin (not shown) by which the mill may be attached to a whipstock in a manner well known per se.

The cutting action of the mill is provided by eight equi-spaced ribs 18 each having an abrasive facing formed by tungsten carbide discs 20 secured in position by brassing. The discs 20 have their leading faces arranged in a plane which is radial with respect to the mill centreline. As seen in FIG. 1, the outer edge of each rib 18 is inclined at a small angle $\alpha$ in the range 1°–10°, such that the outside diameter across the ribs decreases in the upward direction.

This has the effect that in use, with the tapered nose portion 10*b* bearing on the angled face of the whipstock as indicated at 24, the ribs initially contact the casing indicated at 26 at their lower corners. Thus, the cutting action is initially effectively along a circumferential line. As cutting proceeds and as the tool wears, the area of contact will increase somewhat, but it will remain a restricted area approximating to a circumferential line. In prior art starting mills, in contrast, the outer edges of the cutting ribs are parallel to the tool centreline which produces a relatively large contact area, leading to high resisting torque.

The tapered nose portion 10*b* is provided with tungsten carbide pads 27 preferably, as shown, in the form of axially aligned strips, set in recesses. The pads 27 provide wear-resistant bearing surfaces for contact with the whipstock.

The trailing portion 10*a* of the body is hollow for receiving drilling fluid from the interior of the drill string. The drilling fluid is applied to lubricate the blades 18 and flush away cuttings via eight angled bores 28, each exiting in front and near the lower edge of a respective blade 18.

A typical starting mill in accordance with this embodiment has a maximum diameter over the blades of 8.504 inch (216 mm) and blade length of 6.793 inch (172.5 mm) on an overall body length of about 46.5 inch (1.18 m) and diameter of 5.5 inch (140 mm).

Figure 4:
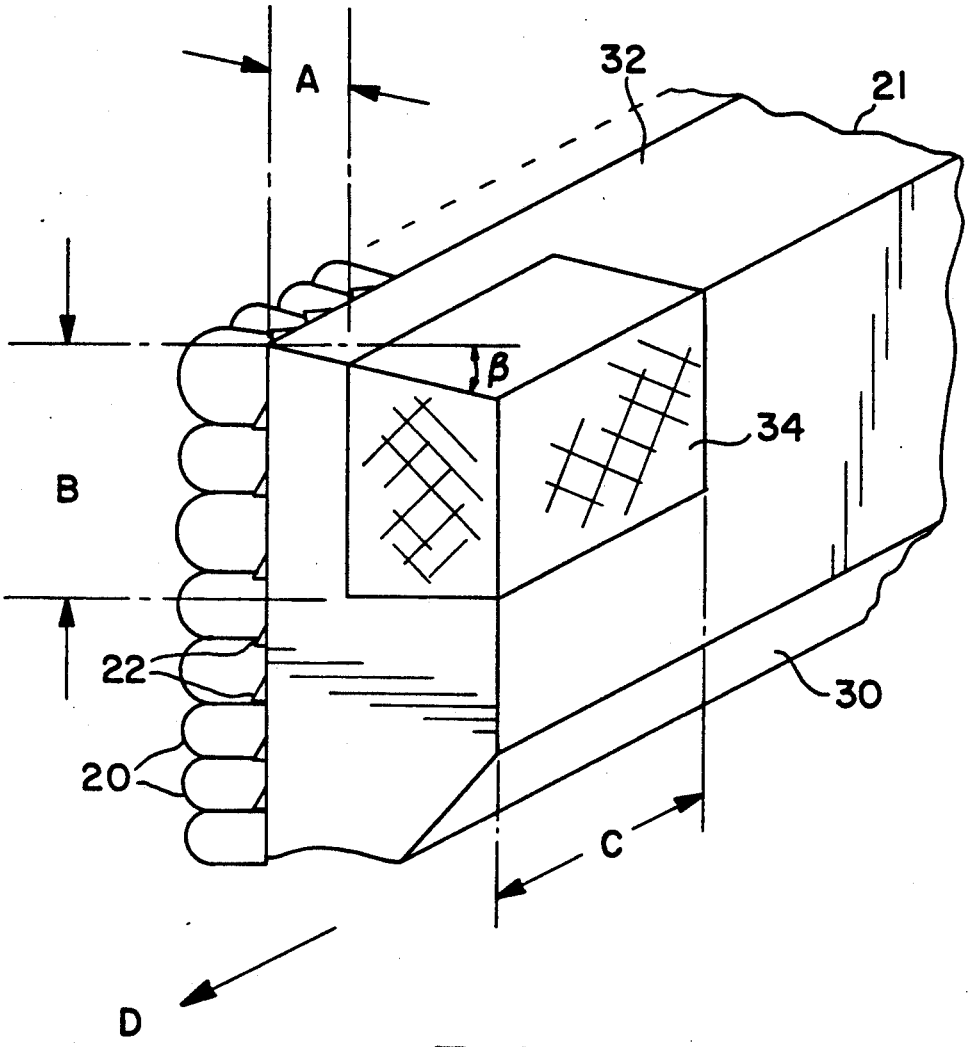
FIG. 4 illustrates in more detail one blade forming part of the mill of FIG. 1.

Referring particularly to FIG. 4 in which the downhole direction is shown by arrow D, the blade 18 comprises a steel body 21 with the carbide discs secured to its front face by a brass matrix as indicated at 22. The rear face is cut away at 30 to provide a welding angle for securing the blade to the body 10. The outer face 32 is at an angle $\beta$ to the tangential to clear the casing when the front face is in cutting contact. The body 20 is cut away at the rear of the leading edge to accommodate a tungsten carbide wear pad 34; preferably the dimensions in this area are A=¼ inch (6.35 mm)
B=1 inch (25.4 mm)
C=2 inch (50.8 mm)

Figure 5:
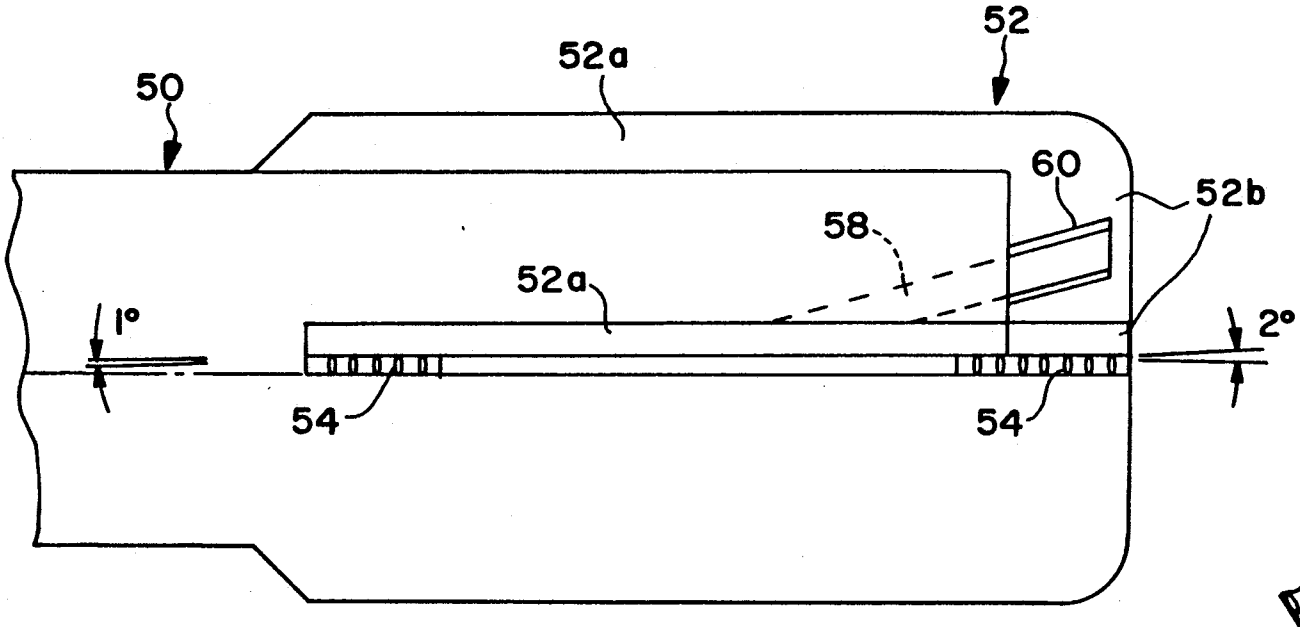
FIG. 5 is a side view, partially in section, of a window mill forming another embodiment of the invention.
Figure 6:
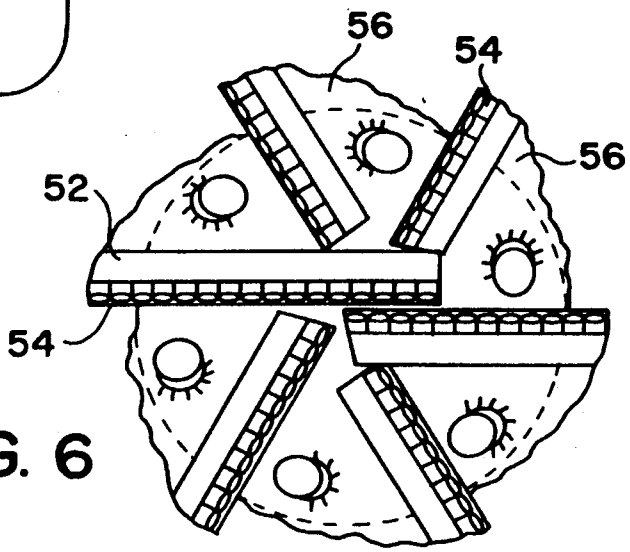
FIG. 6 is an end, view of window mill of FIG. 5.

Turning to FIGS. 5 and 6, the window mill comprises a generally tubular steel body 50 provided at its upper end (not shown) with a standard pin connector for connection on the end of a drill string. The lower end of the mill is provided with six substantially L-shaped blades 52 each having a generally axial portion 52*a* and an inwardly-directed end portion 52*b*. In FIG. 5, for ease of illustration the blade appearing at the top of the figure is shown 30° out of position. Both portions are faced with tungsten carbide discs 54 brassed in place. The blades 52 are welded to the body 50, and are reinforced by a backing 56 of cemented carbide chip material such as "Superloy" by Tri-State.

Drilling fluid is passed from the interior of the body 50 to the blade region via angled bores 58 and pipe nozzles 60.

The generally axial portion 52*a* of the blade is set at a small angle to the axis, such as an angle of 1° increasing to 2° as shown. This has the effect that the end portion 52*b* is parallel to but offset rearwardly from a radius of the tool. Moreover, as seen in FIG. 6, the various end portions 52*b* are of unequal length, so as to overlap in the central zone of the end face.

It has been found with prior art window mills that the operator frequently withdraws the mill before the window is formed, because of penetration rate falling to such an extent that tool failure is suspected.

In such prior art mills, the cutting ribs are axial and radial and are faced with carbide chip compositions. It is believed that this drop in penetration rate occurs when the casing being cut is aligned across the centre of the mill, which produces coring of the tool.

The embodiment of FIG. 5 and 6 overcomes this problem in that the angled disposition of the blades produces a drag type cutting edge, and this is used effectively by the provision of disc-type cutting elements.

Figure 8:
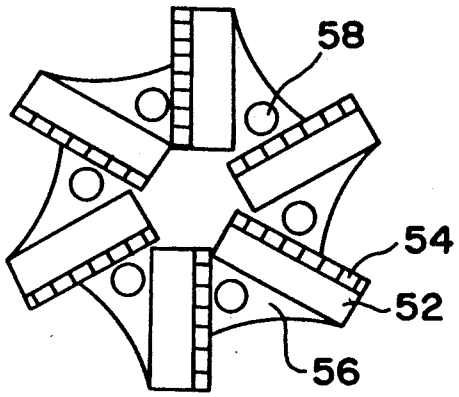
FIG. 7 and 8 are similar views of a modified form of window mill.
Figure 7:
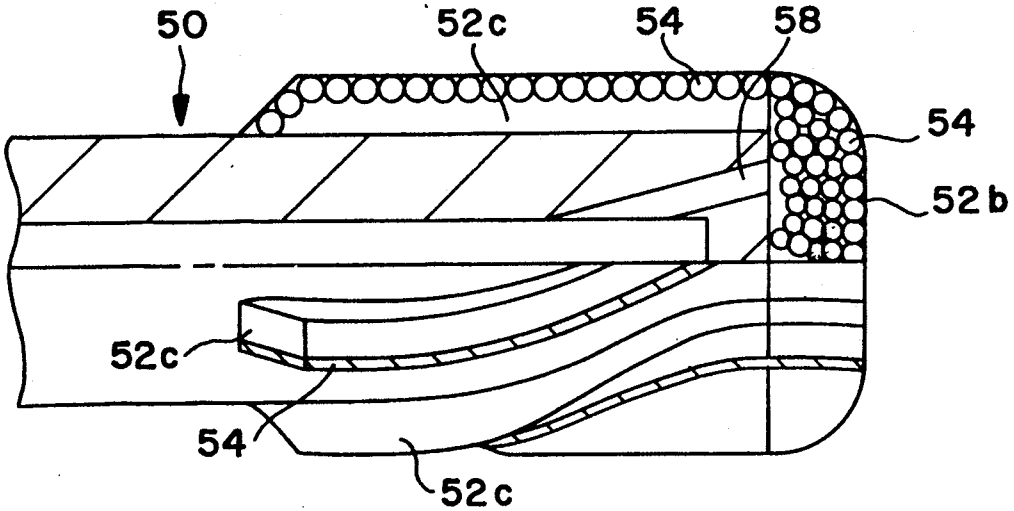

FIG. 7 and 8 are views similar to those of FIG. 5 and 6, illustrating a modified form of window mill, like parts being denoted by like references. In this embodiment, the side portion 52*c* of each rib is helically curved and is provided with carbide discs only along its outer edge.

In all of the foregoing embodiments, the carbide discs are suitably tungsten carbide about ⅜ inch (9.53 mm) diameter by ¼ inch (6.35 mm) thick, for example those produced by Tri-State as "Metal Muncher" inserts.

We claim:

1. A starting mill for use in sidetracking a borehole, said starting mill comprising a generally tubular body, connecting means at one end of said tubular body for connecting said starting mill to an end of a drill string, and a plurality of cutting blades extending radially from and circumferentially spaced around said tubular body, each said cutting blade having a generally radially extending face which is a forward face in the direction of rotation of said starting mill, each said forward face being defined by an array of cutting elements, each said cutting element being in the form of a respective carbide disc secured to said cutting blade, each said cutting blade being angularly offset from and with respect to the longitudinal axis of said tubular body, said tubular body having another end opposite said one end and said other end being formed as a tapered nose, said cutting blades being positioned on said tubular body behind said tapered nose with front surfaces of said carbide discs lying in planes which are radial with respect to said tubular body and said cutting blades each having a respective radially outer edge inclined at an angle to said longitudinal axis of said tubular body such that the outside diameter of said starting mill across said cutting blades is less towards said one end than towards said tapered nose.

2. A starting mill according to claim 1, in which said angle is in the range 1° to 10°.

3. A starting mill according to claim 1, in which said tapered nose is provided with bearing pads in the form of inset areas of carbide material.

4. A starting mill according to claim 1, in which each said cutting blade is provided with a respective bearing pad of carbide material inset in the respective blade at the end thereof nearest said tapered nose on the rear face of the respective blade in the direction of rotation of said starting mill.

5. A starting mill according to claim 1, in which said carbide discs are located in abutment with each other over the whole surface of each respective said forward face.

6. A starting mill according to claim 5, in which the carbide discs are each about ⅜ inch (9.53 mm) diameter by ¼ inch (6.35 mm) thick.

7. A starting mill according to claim 5, in which said carbide discs are secured in position in a brass matrix by brazing.

8. A window mill for use in sidetracking a borehole, said window mill comprising a generally tubular body, connecting means at one end of said tubular body for connecting said window mill to an end of a drill string, and a plurality of cutting blades extending radially from and circumferentially spaced around said tubular body, each said cutting blade having a generally radially extending face which is a forward face in the direction of rotation of said window mill, each said forward face being defined by an array of cutting elements, each said cutting element being in the form of a respective carbide disc secured to said cutting blade, each said cutting blade being angularly offset from and with respect to the longitudinal axis of said tubular body, each said cutting blade having a respective first portion thereof extending along a side of said tubular body and a respective second portion thereof extending across an end face of said tubular body opposite said one end such that each respective front face of said carbide discs on each said cutting blade lies in a respective plan displaced from a radial plane of said tubular body.

9. A window mill according to claim 8, in which said carbide discs are located in abutment with each other over the whole surface of each respective said forward face.

10. A window mill according to claim 9, in which said carbide discs are each about ⅜ inch (9.53 mm) diameter by ¼ inch (6.35 mm) thick.

11. A window mill according to claim 9, in which said carbide discs are secured in position in a brass matrix by brazing.

12. A window mill according to claim 8, in which said second portions of said cutting blades are of mutually differing lengths to provide an overlapping disposition thereof in a central zone of said end face.

13. A window mill according to claim 8, in which each said cutting blade is substantially straight and has the respective said first portion thereof extending along the side of said tubular body at an angle with respect to said longitudinal axis of said tubular body.

14. A window mill according to claim 13, in which said angle is in the range 1° to 2°.

15. A window mill according to claim 8, in which the respective said second portion of each said cutting blade is reinforced by a respective body of cemented carbide chips positioned between a rear face of the respective said second portion and said end face of said tubular body.

* * * * *